US009000870B2

(12) United States Patent
Naiman et al.

(10) Patent No.: US 9,000,870 B2
(45) Date of Patent: Apr. 7, 2015

(54) MULTIPOLAR ELECTRICAL SWITCH

(71) Applicants: Pavel Naiman, Letohrad (CZ); Milos Petracek, Letohrad (CZ)

(72) Inventors: Pavel Naiman, Letohrad (CZ); Milos Petracek, Letohrad (CZ)

(73) Assignee: Siemens Aktiengesellschaft, Munich (DE)

( * ) Notice: Subject to any disclaimer, the term of this patent is extended or adjusted under 35 U.S.C. 154(b) by 80 days.

(21) Appl. No.: 13/665,053

(22) Filed: Oct. 31, 2012

(65) Prior Publication Data

US 2013/0120092 A1 May 16, 2013

(30) Foreign Application Priority Data

Nov. 14, 2011 (DE) ..... 10 2011 086 308

(51) Int. Cl.

| | |
|---|---|
| ***H01H 75/00*** | (2006.01) |
| ***H01H 1/20*** | (2006.01) |
| ***H01H 71/02*** | (2006.01) |
| ***H01H 71/10*** | (2006.01) |

(52) U.S. Cl.

CPC ..... *H01H 71/0271* (2013.01); *H01H 71/1009* (2013.01)

(58) Field of Classification Search

CPC ..... H01H 71/1009
USPC ..... 335/8–10; 218/152, 153; 200/50.32, 200/50.37, 50.39, 50.4
See application file for complete search history.

(56) References Cited

U.S. PATENT DOCUMENTS

| | | | | |
|---|---|---|---|---|
| 3,840,833 | A * | 10/1974 | Mrenna et al. | 337/43 |
| 4,079,345 | A * | 3/1978 | Pietsch | 335/10 |
| 4,931,602 | A * | 6/1990 | Toda et al. | 218/153 |
| 5,281,776 | A | 1/1994 | Morel et al. | |
| 7,116,194 | B2 | 10/2006 | Azzola et al. | |
| 2007/0056931 | A1 | 3/2007 | Turkmen | |

FOREIGN PATENT DOCUMENTS

| | | | |
|---|---|---|---|
| DE | 60211028 | T2 | 10/2006 |
| DE | 102005043396 | A1 | 3/2007 |
| DE | 102008039066 | A1 | 2/2010 |
| EP | 0335823 | A1 | 10/1989 |

OTHER PUBLICATIONS

German Office Action for German Application No. DE 10 2011 086 308.7 dated Jul. 22, 2012.
Priority Document German Application No. DE 10 2011 086 308.7 filed Nov. 14, 2011.

* cited by examiner

*Primary Examiner* — Ramon Barrera
(74) *Attorney, Agent, or Firm* — Harness, Dickey & Pierce, P.L.C.

(57) ABSTRACT

A multipolar electrical switch includes at least one central pole housing, which adjoins two adjacent pole housings of the switch. In at least one embodiment of the invention, an electrical switching mechanism for switching an electrical phase current on and off is contained in each of the pole housings respectively. The central pole housing is equipped with a fastening element, which extends through the central pole housing into the two adjacent pole housings, namely in each instance to at most the center of the adjacent pole housings.

15 Claims, 5 Drawing Sheets

MULTIPOLAR ELECTRICAL SWITCH

PRIORITY STATEMENT

The present application hereby claims priority under 35 U.S.C. §119 to German patent application number DE 10 2011 086 308.7 filed Nov. 14, 2011, the entire contents of which are hereby incorporated herein by reference.

FIELD

At least one embodiment of the invention generally relates to a multipolar electrical switch.

BACKGROUND

A multipolar electrical switch of this type is known for instance from the European patent application EP 0 335 823 A1. This known switch comprises three pole housings, which are connected to one another by way of connecting pins or bolts.

Another electrical switch is known from the unexamined German patent application DE 10 2008 039 066 A1. This switch includes a rotor housing and an electrical contact bridge which is rotatable mounted in the rotor housing and can be pivoted between an on and off position and relative to the rotor housing. The contact bridge can be pivoted for switching on and off, by the rotor housing being rotated. Here the rotating rotor housing pivots with the contact bridge. Furthermore, the contact bridge can also pivot without rotation of the rotor housing, in other words relative to the rotor housing, if namely the current flowing across the contact bridge becomes too great. In this case, the contact bridge is pivoted opposite the rotor by way of a magnetic force produced by the current, as a result of which the contact elements of the contact bridge and the fixed contact elements of the switch are separated from one another.

SUMMARY

A multipolar electrical switch is disclosed, which can be produced in a cost-effective manner, but nevertheless has a very large mechanical stability.

Advantageous embodiments of the inventive switch are specified in the subclaims.

Provision is thereby made in accordance with at least one embodiment of the invention for an electrical switching mechanism for switching an electrical phase current on and off to be contained in each of the pole housings respectively and for a central pole housing to be equipped with a fastening element, which extends through the central pole housing into the two adjacent pole housings, namely in each instance to at most the center of the adjacent pole housings.

BRIEF DESCRIPTION OF THE DRAWINGS

The invention is described in more detail below with the aid of example embodiments, in which, by way of example.

For the sake of clarity, the same reference characters are always used in the figures for identical or comparable components.

DETAILED DESCRIPTION OF THE EXAMPLE EMBODIMENTS

Figure 1:
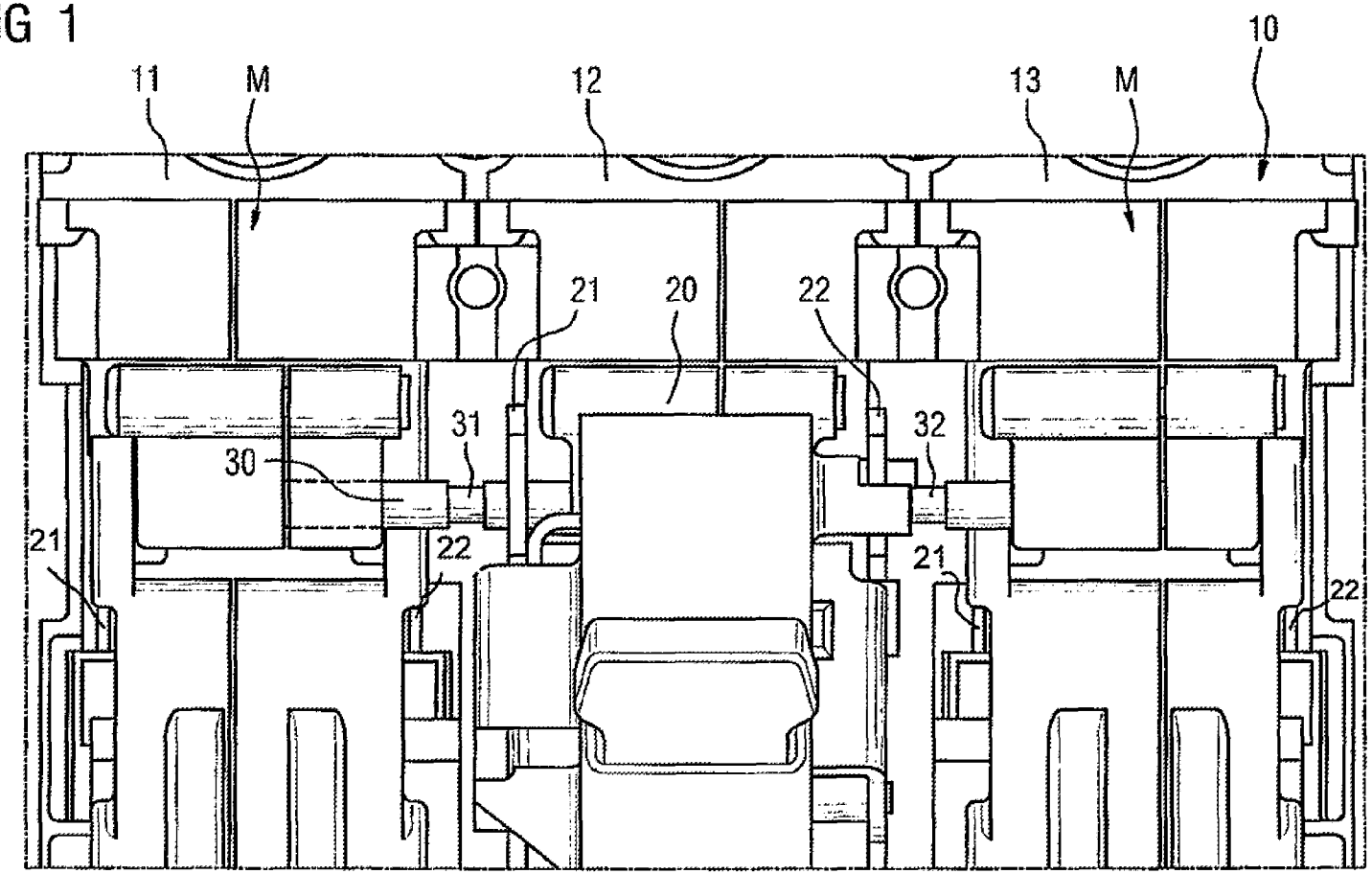
FIG. 1 shows a first example embodiment of an inventive switch in a view from above.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

One significant advantage of at least one embodiment of the inventive switch is that, on account of the inventively provided fastening element, this is very stable even with relatively thin housing walls of the central pole housing. The fastening element provides that when switching the switching mechanism arranged in the third pole housing, the resulting mechanical forces can be absorbed not only by the central pole housing, but additionally also by the two adjacent pole housings. The central pole housing can therefore be produced in a less stable manner and with lower manufacturing costs, than would be necessary if the inventive fastening element was not present.

A further significant advantage of at least one embodiment of the inventive switch lies in the inventively proposed length of the fastening element. The fastening element inventively extends into the two adjacent pole housings only to at most the center in each instance. Such a length ensures optimal force distribution and at the same time prevents the fastening element from extending unnecessarily deeply into the adjacent pole housings, for instance completely through the adjacent pole housings. The inventive fastening element can therefore be produced with minimal manufacturing costs and minimal weight.

In order to achieve a fixed fastening of the fastening element in the central pole housing, it is considered to be advantageous if the switching mechanism of the central pole housing has two side plates, which laterally delimit the switching mechanism, and the fastening element is guided through holes in the two side plates.

With respect to a particularly stable embodiment of the switch, it is considered to be advantageous if the switching mechanism of at least one of the two adjacent pole housings has a side plate, through which the fastening element is guided.

In order to prevent the fastening element from displacing or moving in the adjacent pole housings, it is considered to be advantageous if a holding element is contained in at least one of the two adjacent pole housings, which holds and/or fixes the end section of the fastening element found in the pole housing.

The at least one holding element particularly preferably holds and/or fixes an end section of the fastening element in the center of the respective pole housing.

With respect to a defined position of the fastening element within the pole housings and an optimal force distribution in the event of a switchover of the switching mechanism found in the central pole housing, it is considered to be advantageous if one of the two end sections of the fastening element is disposed in the center of the one adjacent pole housing and the other of the two end sections of the fastening element is disposed in the center of the other adjacent pole housing, if a holding element holds and/or fixes the one end section of the fastening element in the center of the one adjacent pole housing and another holding element holds and/or fixes the other end section of the fastening element in the center of the other adjacent pole housing.

With respect to simple assembly of the switch, it is considered to be advantageous if the pole housings are at least in two parts respectively and comprise a lower housing part and an upper housing part.

In the event of a two-part pole housing structure, it is advantageous if the fastening element rests on the upper edge of the lower housing part of the central pole housing.

It is considered to be particularly advantageous if in each case the upper edge of the lower housing part of the central pole housing has a recess at the two housing walls which adjoin the housing walls of the two adjacent pole housings, in which recess the fastening element lies.

Furthermore, it is considered to be advantageous if the fastening element comprises at least one section with a reduced cross-section and lies with this in a recess in the upper edge of the lower housing part of one of the pole housings.

Aside from the fastening element already mentioned, for connecting the pole housings, further fastening elements may also be present. It is considered to be advantageous if the switch comprises a further fastening element, which extends from the central pole housing to at most the center of one or both adjacent pole housings.

FIG. 1 shows a three-pole electrical switch 10, which has three pole housings arranged adjacent to one another in the shape of pole cassettes. The left pole housing in FIG. 1 is identified with reference character 11, the central pole housing with reference character 12 and the right pole housing in FIG. 1 with reference character 13.

The three pole housings 11, 12, and 13 are equipped in each instance with a switching mechanism, which enables an electrical phase current to be switched on and off. Of the three switching mechanisms of the switch 10, only the switching mechanism of the central pole housing 12 is identified in more detail in FIG. 1, namely with the reference character 20.

In order to achieve an optimal force distribution when actuating the switching mechanism 20 of the central pole housing 12, the switch 10 according to FIG. 1 is equipped with an additional fastening element 30, which is preferably a fastening pin, a fastening rod or a fastening bolt. The fastening element 30 extends through the central pole housing 12 of the switch 10 and also into both adjacent pole housings 11 and 13 in each instance. It is apparent in FIG. 1 that the fastening element 30 only extends partially into the two adjacent pole housings 11 and 13, namely to at most the center M of the two adjacent pole housings.

In order to prevent a slip or displacement of the fastening element 30 along its longitudinal axis, the fastening element 30 is equipped with two sections 31 and 32, which have a reduced cross-section. The sections 31 and 32 are placed in corresponding recesses in the pole housings 11, 12 and/or 13 and prevent the fastening element from displacing in this way.

Two side plates of the switching mechanism 20 are identified in FIG. 1 with the reference characters 21 and 22, which are for instance side panels. It can be seen that the fastening element 30 is guided through holes in these two side plates 21 and 22.

Figure 2:
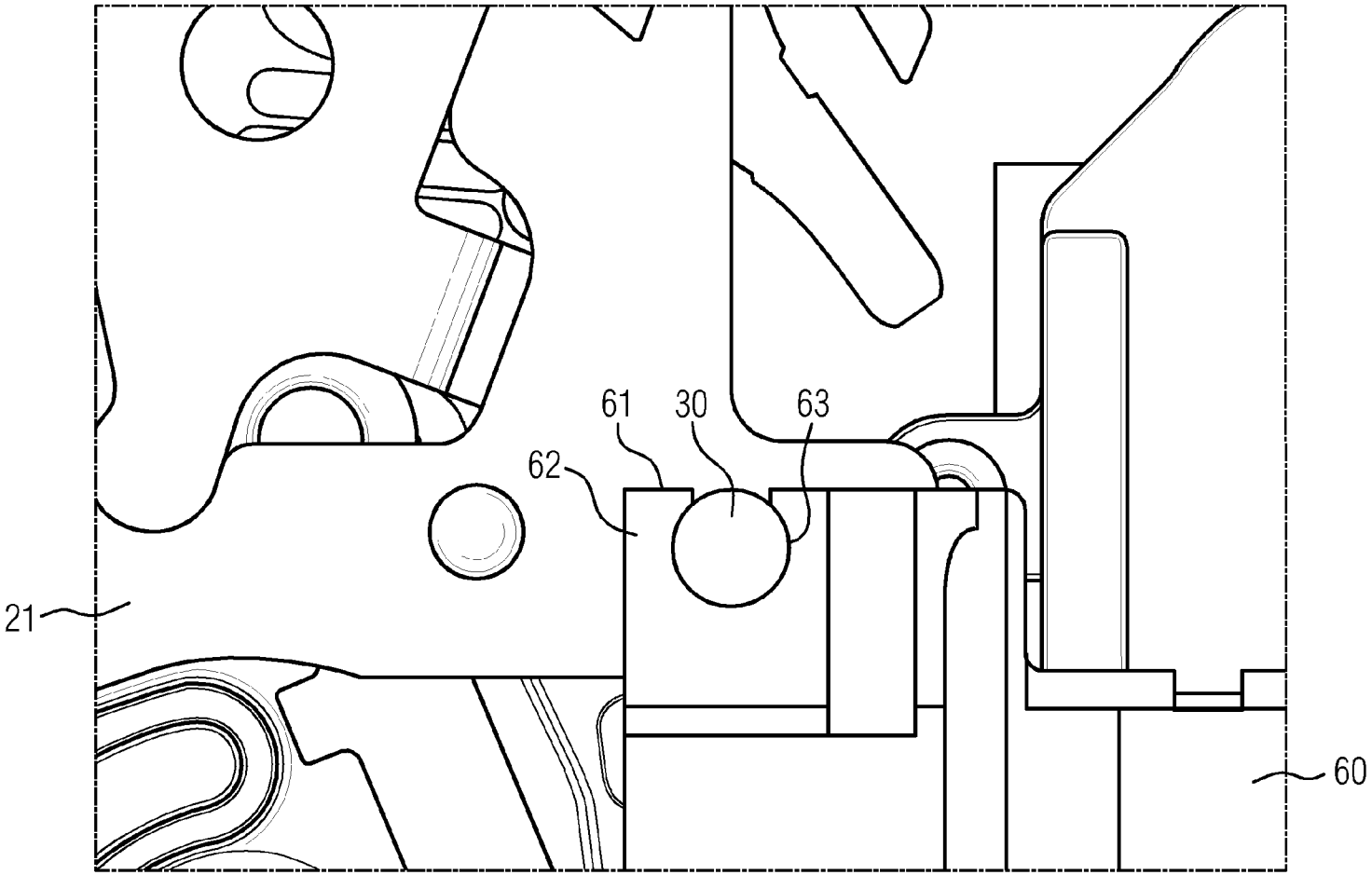
FIG. 2 shows the arrangement of a fastening element of the switch according to FIG. 1 in a view from the side.

FIG. 2 shows the arrangement of the fastening element 30 in a view from the side. It is apparent that the fastening element 30 is guided through the side plate 21 of the switching mechanism 20 and is held by a lower housing part 60 of the central pole housing. In order to hold the fastening element 30, the upper edge 61 of a lateral housing wall 62 of the lower housing part 60 is equipped with a recess 63 in the form of a depression (e.g. semicircular depression), into which the fastening element 30 is placed.

Figure 3:
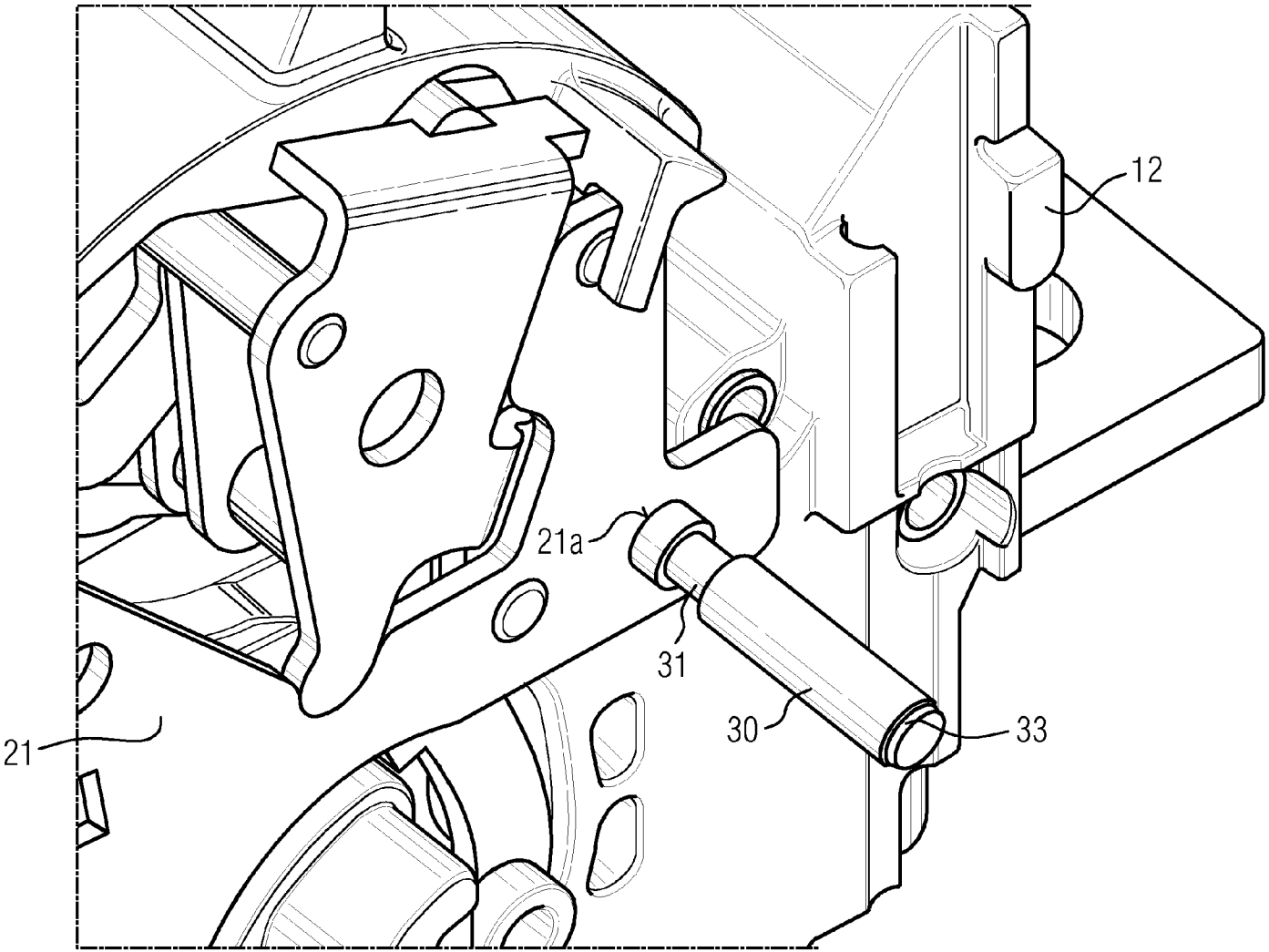
FIG. 3 shows the switch according to FIGS. 1 and 2 in a three-dimensional view, wherein an end section of the fastening element according to FIG. 2 can be seen.

FIG. 3 shows the switch 10 according to FIGS. 1 and 2 in a three-dimensional view. The side plate 21 of the switching mechanism, which is accommodated in the central pole housing 12 of the switch, is visible.

It is furthermore apparent how the fastening element 30 is guided through a hole 21*a* in the side plate 21. Furthermore, the section 31 of the fastening element 30 is visible with the reduced cross-section. With this section 31, the fastening element 30 is preferably placed in the recess 63 (cf. FIG. 2) in the upper edge 61 of the lateral housing wall 62 of the lower housing part 60.

It is also visible in FIG. 3 that the fastening element 30 is equipped in each instance with a holding section 33 in the region of its two end sections, said holding section 33 enabling a holding element to be attached in order to fix the fastening element 30 in the respectively adjacent pole housing. The attachment of such a holding element for the secure positioning of the fastening element 30 within the pole housing is particularly advantageous, but is not absolutely necessary. On account of the two afore-described sections 31 and 32 with the reduced cross-section, an adequate fixing of the fastening element 30 is already achieved in most cases.

Figure 4:
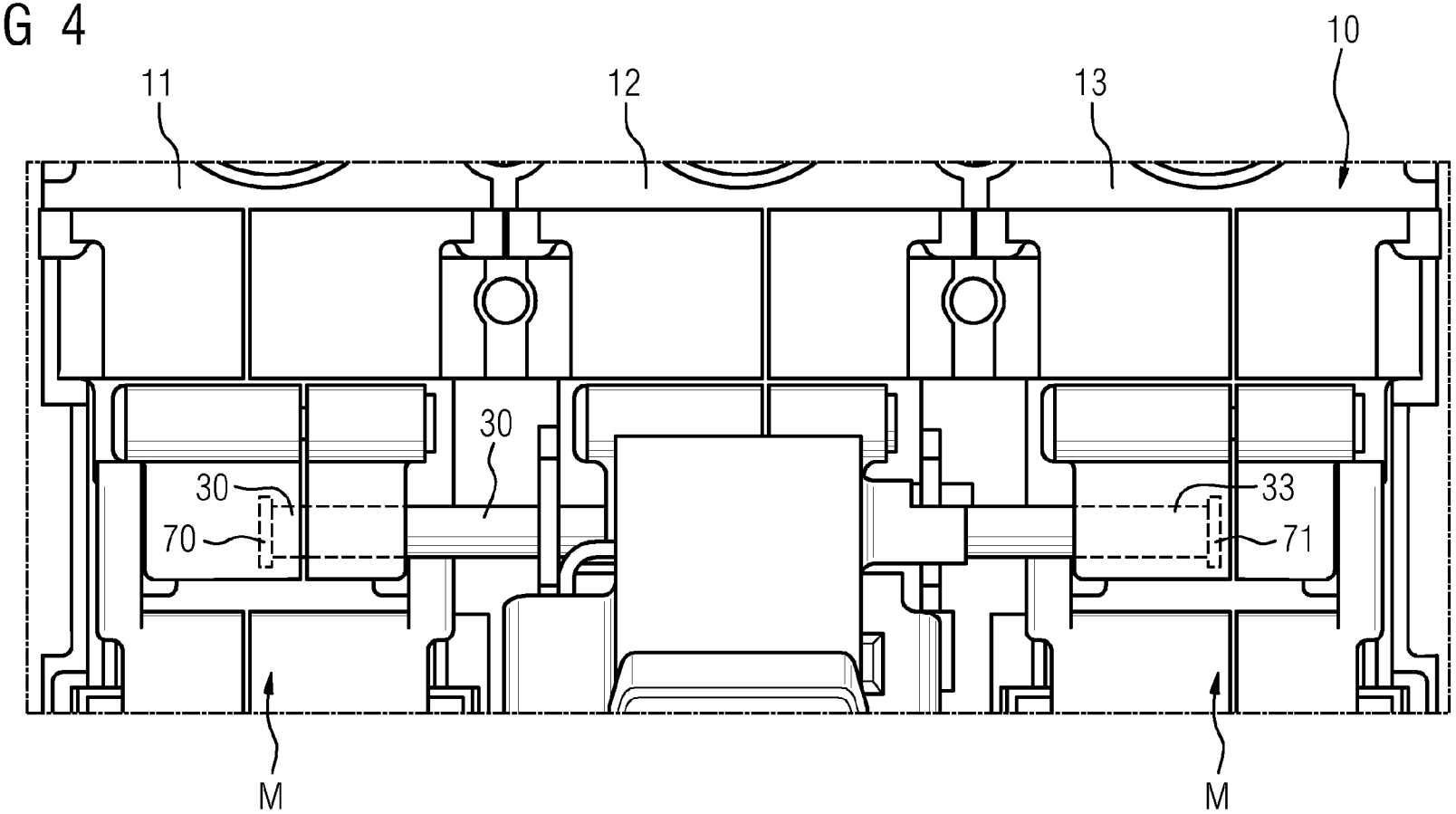
FIG. 4 shows a second example embodiment of an inventive electrical switch, in which the end sections of the fastening element are each fixed additionally with a holding element.

FIG. 4 shows by way of example, an example embodiment of a switch 10, in which a holding element is attached in each instance to the fastening element 30 in the region of the two holding sections 33 respectively. The two holding elements are identified in FIG. 4 with the reference characters 70 and 71. The two holding elements 70 and 71 enable the position of the fastening element 30 to be securely fixed between the center M of the left pole housing 11 and the center M of the right pole housing 13, so that the fastening element is not moveable along its longitudinal direction.

With the additional fixing of the fastening element 30 with the two holding elements 70 and 71 shown in FIG. 4, it is possible to dispense with sections 31 and 32 with a reduced cross-section, as shown in FIGS. 1 and 3. It is naturally also possible to combine these sections 31 and 32 with the holding elements 70 and 71 shown in FIG. 4 in order to optimize the fixing of the fastening element 30.

Figure 5:
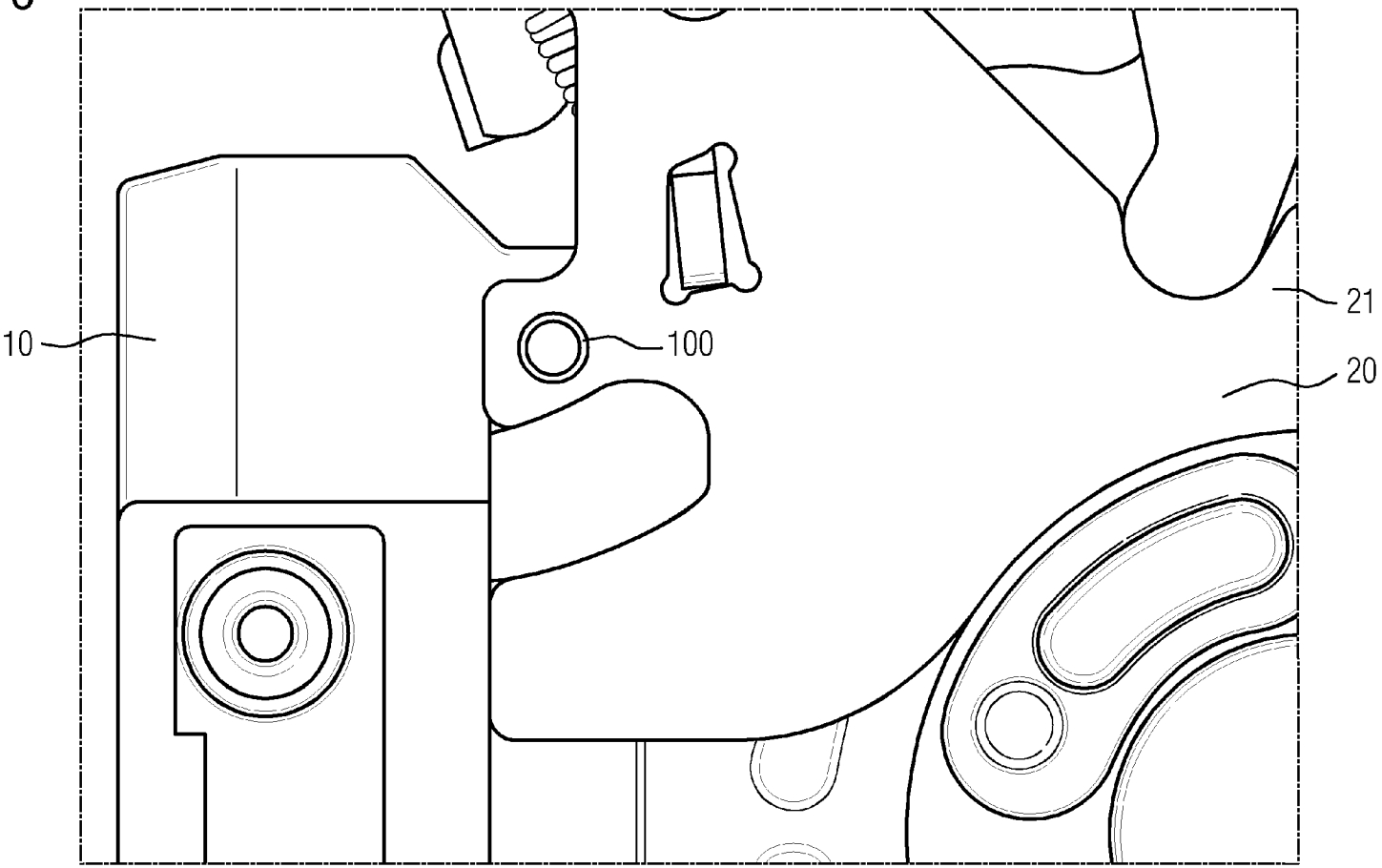
FIG. 5 shows a third example embodiment of an inventive switch, in which a further fastening element is additionally provided, which extends into at least one of the adjacent pole housings.

FIG. 5 shows a third example embodiment of a switch 10. In this example embodiment, in addition to a fastening element, as was already explained in conjunction with FIGS. 1 to 4, a further fastening element 100 exists, which enables a mechanical coupling of the central pole housing to one or both of the adjacent pole housings. This further fastening element 100 is preferably fastened to one of the two side plates of the switching mechanism 20, for instance the side plate 21 according to FIG. 1, in order to enable a transmission of force between the pole housings, for instance between the left pole housing 11 in FIG. 1 and the central pole housing 12.

Although the invention was illustrated and described in more detail by the preferred example embodiments, the invention is not restricted by the disclosed examples and other variations can be derived herefrom by the person skilled in the art without departing from the scope of protection of the invention.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

10 switch
11 left pole housing
12 central pole housing
13 right pole housing
20 switching mechanism
21 side plate
21*a* hole
22 side plate
30 fastening element
31 section
32 section
33 holding section
60 lower housing part
61 upper edge
62 lateral housing wall
63 recess
70 holding element
71 holding element
100 fastening element
M center

What is claimed is:

1. A multipolar electrical switch, comprising:

at least one central pole housing adjoining two adjacent pole housings of the switch; and electrical switching mechanisms, one of the electrical switching mechanisms being contained in each of the pole housings, each electrical switching mechanism being configured to switch an electrical phase current on and off, the at least one central pole housing being equipped with a fastening element extending through the at least one central pole housing into at most, a center of the adjacent pole housings, wherein the fastening element includes at least one section with a reduced cross-sectional area that is configured to rest in a recess of one of the pole housings, and portions of the fastening element on both sides of the at least one section have cross-sectional areas greater than the at least one section.

2. The multipolar electrical switch of claim 1, wherein the switching mechanism of the at least one central pole housing comprises two side plates which laterally delimit the switching mechanism, and wherein the fastening element is guided through holes in the two side plates.

3. The multipolar electrical switch of claim 1, wherein the switching mechanism of at least one of the two adjacent pole housings comprises a side plate, through which the fastening element is guided.

4. The multipolar electrical switch of claim 1, wherein a holding element, contained in at least one of the two adjacent pole housings, is configured to at least one of hold and fix an end section of the fastening element disposed in the pole housing.

5. The multipolar electrical switch of claim 4, wherein the at least one holding element is configured to at least one of hold and fix an end section of the fastening element in the center of the pole housing.

6. The multipolar electrical switch of claim 4, wherein one of the two end sections of the fastening element is in the center of the one adjacent pole housing and the other of the two end sections of the fastening element is in the center of the other adjacent pole housing, said holding element is configured to at least one of hold and fix the one end section of the fastening element in the center of the one adjacent pole housing, and another holding element is configured to at least one of hold and fix the other end section of the fastening element in the center of the other adjacent pole housing.

7. The multipolar electrical switch of claim 1, wherein the pole housings are each in at least two parts and each comprise a relatively lower housing part and a relatively upper housing part.

8. The multipolar electrical switch of claim 7, wherein the fastening element rests on an upper edge of the lower housing part of the central pole housing.

9. The multipolar electrical switch of claim 8, wherein the upper edge of the lower housing part of the central pole housing comprises the recess at the two housing walls adjoining the housing walls of the two adjacent pole housings respectively, in which the fastening element lies.

10. The multipolar electrical switch of claim 7, wherein the recess is in the upper edge of the lower housing part of one of the pole housings.

11. The multipolar electrical switch of claim 1, further comprising a further fastening element extending from the central pole housing to at most the center of one or both adjacent pole housings.

12. The multipolar electrical switch of claim 8, wherein the recess is in the upper edge of the lower housing part of one of the pole housings.

13. The multipolar electrical switch of claim 2, further comprising a further fastening element extending from the central pole housing to at most the center of one or both adjacent pole housings.

14. The multipolar electrical switch of claim 2, wherein the switching mechanism of at least one of the two adjacent pole housings comprises a side plate, through which the fastening element is guided.

15. The multipolar electrical switch of claim 2, wherein a holding element, contained in at least one of the two adjacent pole housings, is configured to at least one of hold and fix an end section of the fastening element disposed in the pole housing.

* * * * *